US005270583A

United States Patent [19]

Miyawaki et al.

[11] Patent Number: 5,270,583

[45] Date of Patent: Dec. 14, 1993

[54] IMPEDANCE CONTROL CIRCUIT FOR A SEMICONDUCTOR SUBSTRATE

[75] Inventors: Naokazu Miyawaki, Yokohama; Kiyoharu Murakami, Kawasaki, both of Japan

[73] Assignee: Kabushiki Kaisha Toshiba, Kawasaki, Japan

[21] Appl. No.: 687,188

[22] Filed: Apr. 18, 1991

[30] Foreign Application Priority Data

Apr. 18, 1990 [JP] Japan ..... 2-102137

[51] Int. Cl.[5] ..... H03K 3/01

[52] U.S. Cl. ..... 307/296.2; 307/304; 307/296.8

[58] Field of Search ..... 307/296.2, 296.8, 303, 307/304

[56] References Cited

U.S. PATENT DOCUMENTS 4,438,346 3/1984 Chuang et al. ..... 307/304
4,571,505 2/1986 Eaton, Jr. ..... 307/296.4
4,670,668 6/1987 Liu ..... 307/296.2
4,716,307 12/1987 Aoyama ..... 307/296.8
4,794,278 12/1988 Vajdic ..... 307/296.2
5,057,704 10/1991 Koyanagi et al. ..... 307/296.2

FOREIGN PATENT DOCUMENTS 9008426 7/1990 World Int. Prop. O. ..... 307/296.2

*Primary Examiner*—Timothy P. Callahan
*Attorney, Agent, or Firm*—Foley & Lardner

[57] ABSTRACT

The semiconductor circuit device comprises a substrate bias generating circuit, a substrate voltage detecting circuit, and a substrate impedance adjusting circuit. When the detected substrate voltage decreases below a predetermined level, the substrate impedance adjusting circuit forms a through route between a substrate voltage terminal and any given terminal higher in potential than the substrate voltage terminal, to increase the substrate voltage at high speed, thus stabilizing threshold voltages or operation limit voltages of device elements which are subjected to the influence of the substrate voltage. Further, when the substrate voltage returns to the predetermined level, the substrate impedance adjusting circuit cuts off the formed through route for reduction of power consumption.

4 Claims, 4 Drawing Sheets

FIG. 8A
FIG. 8B
FIG. 8C
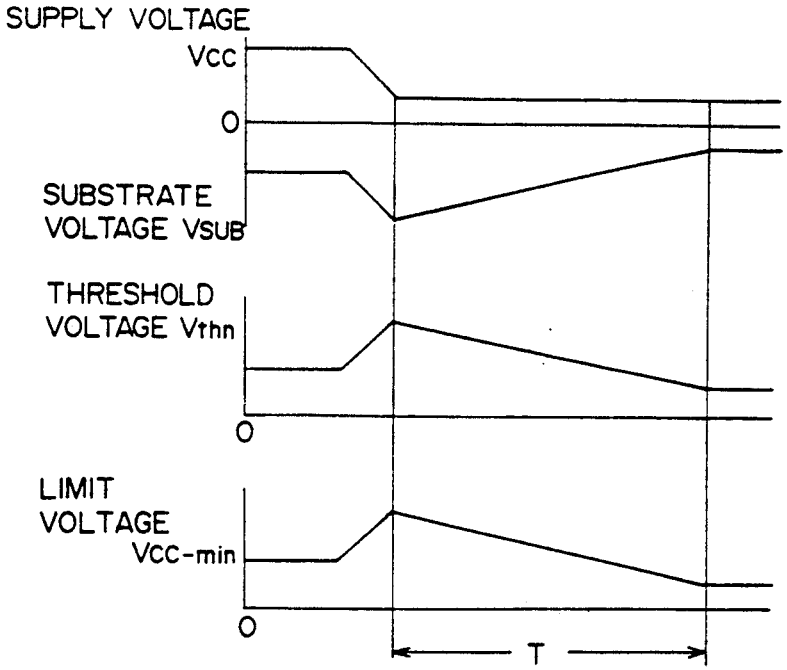
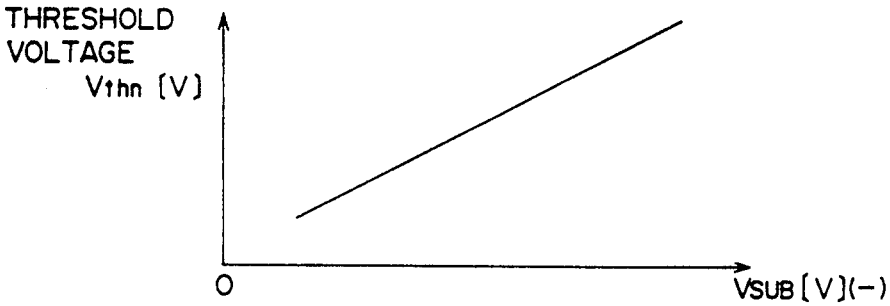
FIG. 9
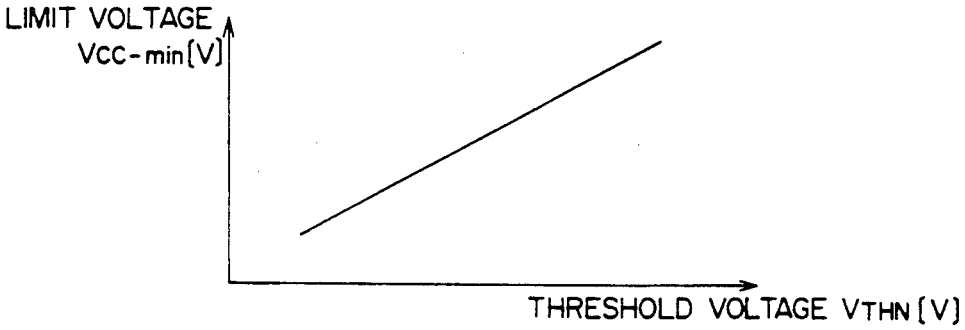
FIG. 10

IMPEDANCE CONTROL CIRCUIT FOR A SEMICONDUCTOR SUBSTRATE

BACKGROUND OF THE INVENTION

The present invention relates to a semiconductor circuit device, and more specifically to a semiconductor circuit device whose substrate impedance is adjustable according to supply voltage fluctuations.

In semiconductor memory devices, a substrate bias voltage is often applied to a semiconductor substrate, in order to prevent a parasitic pn junction from being biased in the forward direction due to the undershoot of an external signal or to increase the circuit operation speed by increasing the depletion layer width of a junction for reduction of a parasitic capacitance.

FIG. 4B shows a so-called charge-pump circuit which can generate a substrate bias voltage. In this charge-pump circuit, when a pulsed input signal as shown in FIG. 4A is inputted to a node N40, an N-channel transistor TR2 pumps up electric charge from a semiconductor substrate and further accumulates it into a capacitor C2. Further, after an N-channel transistor TP1 has accumulated this accumulated charge into a capacitor C1, the N-channel transistor TR1 discharges it to a ground potential $V_{SS}$, so that a substrate voltage $V_{SUB}$ can be outputted from a node N41.

FIG. 5 shows the substrate voltage characteristics generated by the charge-pump circuit as shown in FIG. 4B. In FIG. 5, when the supply voltage $V_{CC}$ decreases from the ordinary voltage $V_{CC1}$ to another voltage $V_{CC2}$, the substrate voltage $V_{SUB}$ changes from $V_{SUB1}$ to $V_{SUB2}$ in the negative direction. That is, when the supply voltage $V_{CC}$ drops abruptly from $V_{CC1}$ to $V_{CC2}$ as shown in FIG. 6, the substrate voltage once drops down to voltage $V_{SUB1D}$ lower than the voltage $V_{SUB1}$ and then returns to the voltage $V_{SUB2}$ into a stable condition after a time T represented by a time constant $T=C \cdot R$ has elapsed, where C denotes a substrate capacitance and R denotes a substrate impedance.

In this case, the relationship between the substrate voltage $V_{SUB}$ and the substrate current $I_{SUB}$, that is, the load characteristics of the substrate bias voltage generating circuit can be represented as shown in FIG. 7, in which almost no current flows through the substrate when the substrate voltage changes from $V_{SUB1D}$ to $V_{SUB2}$. Therefore, although the substrate impedance is substantially decided by only leakage current flowing through PN junctions formed in the substrate, since the leakage current is extremely small, the substrate impedance R is extremely high. Consequently, the time T required when the substrate voltage returns from $V_{SUB1D}$ to $V_{SUB2}$ becomes long due to this high substrate impedance R. This causes the following problems:

When the supply voltage drops abruptly, since the substrate voltage $V_{SUB}$ once drops and then increases as shown in FIG. 8A, the threshold voltage $V_{thn}$ of each transistor formed on the same substrate changes as shown in FIG. 8B. This is caused by a back-gate bias effect such that the threshold voltage $V_{thn}$ increases with decreasing substrate voltage $V_{SUB}$ in the negative direction as shown in FIG. 9. Therefore, the limit voltage $V_{CC\text{-}min}$ at which each element formed on the substrate operates normally is largely dependent upon the threshold voltage $V_{thn}$, as shown in FIG. 10. Accordingly, the limit voltage $V_{cc\text{-}min}$ changes when the threshold voltage $V_{thn}$ changes, and becomes stable when the threshold voltage $V_{thn}$ becomes stable, as shown in FIG. 8C.

In other words, when the supply voltage $V_{CC}$ fluctuates, a long time T required until the substrate voltage $V_{SUB}$ becomes stable, causes an unstable operation of the respective elements formed on the substrate. In particular, where data stored in memory devices are backed up by a battery and therefore the supply voltage drops momentarily, there exists a serious problem in that the data stored in the memory devices are not kept stored.

As described above, in the prior-art semiconductor circuit device, since it takes a long time until the substrate voltage becomes stable whenever the supply voltage fluctuates, there exists a problem in that the operation of the circuit formed on the substrate is unstable.

SUMMARY OF THE INVENTION

Therefore, the object of the present invention is to provide a semiconductor circuit device stable in circuit operation even if the supply voltage fluctuates.

To achieve the above-mentioned object, the present invention provides a semiconductor circuit device comprising: a substrate bias generating circuit for generating a substrate bias voltage applied to a substrate; a substrate voltage detecting circuit for detecting the substrate voltage applied to the substrate; and a substrate impedance adjusting circuit for adjusting impedance of the substrate in such a way that a through route is formed between a substrate voltage terminal and any given terminal higher in potential than the substrate voltage terminal, to increase the substrate voltage, whenever the detected substrate voltage decreases below a predetermined level, and the formed through route is cut off after the substrate voltage has reached the predetermined level.

In the semiconductor circuit device according to the present invention, the substrate voltage is detected by the substrate voltage detecting circuit. In case the detected substrate voltage drops below a predetermined level due to supply voltage fluctuations, the substrate impedance adjusting circuit forms a through route between a substrate voltage terminal and any given voltage terminal higher in voltage than the substrate voltage terminal, in order to raise the substrate voltage at high speed. Therefore, since the substrate voltage quickly reaches a predetermined voltage level, it is possible to stabilize the threshold voltages of the respective elements or the operation limit voltage which are subjected to the influence of the substrate voltage, thus allowing the semiconductor circuit device to operate stably. Further, when the substrate voltage reaches the predetermined level, since the substrate impedance adjusting circuit cuts off the formed through route, the power consumption can be reduced.

In the case where the substrate impedance adjusting circuit includes the through-route forming transistor and control means, whenever the substrate voltage drops below a predetermined level, the control means turns on the through-route forming transistor to form a through route. Further, after the substrate voltage has reached the predetermined level, the through-route forming transistor is turned off to cut off the formed through route.

In the case where the substrate voltage detecting circuit includes converting means and delaying means, the detected substrate voltage is converted into a signal corresponding to the level thereof and further delayed for prevention of hunting, before being outputted. The converted and delayed signal is given to a pair of P-channel transistors of the substrate impedance adjusting circuit. In response to signals of the P-channel transistors, a flip-flop is set or reset. The output of the flip-flop is given to a gate of the through-route forming circuit, so that the operation of through-route forming circuit is controlled on the basis of the substrate voltage level, in order to form or cut off the through route.

In the case where the substrate voltage detecting circuit further comprises bias control signal outputting means for outputting a signal corresponding to the substrate voltage to the substrate bias generating circuit, it is possible to improve the circuit density by providing this outputting means in common. In this embodiment, since the substrate impedance is adjusted only when the substrate voltage drops markedly due to supply voltage fluctuations, it is necessary to determine the absolute value of the substrate voltage required to form the through route to be higher than the absolute value of the control voltage required when the substrate bias generating circuit controls the substrate bias voltage.

BRIEF DESCRIPTION OF THE DRAWINGS

In the attached drawings,

FIGS. 8A, 8B and 8C are graphical representations for assistance in explaining the influence of substrate voltage fluctuations upon limit voltage $V_{CC\text{-}min}$;

FIG. 9 is a graphical representation for assistance in explaining a back-bias effect; and FIG. 10 is a graphical representation for assistance in explaining the relationship between the threshold voltage $V_{thn}$ and the limit voltage $V_{CC\text{-}min}$.

DESCRIPTION OF THE PREFERRED EMBODIMENTS

Embodiments of the present invention will be described hereinbelow with reference to the attached drawings.

Figure 1:
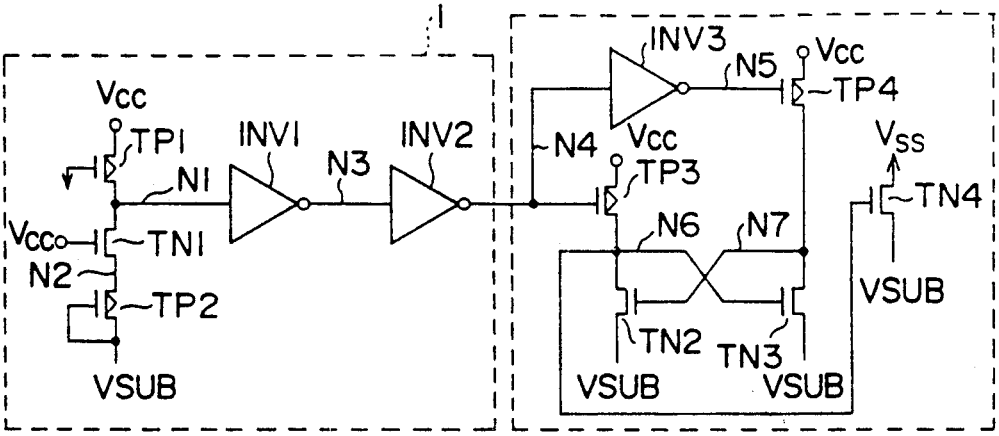
FIG. 1 is a circuit diagram showing an embodiment of the semiconductor circuit device according to the present invention.

FIG. 1 is a circuit diagram showing an embodiment of the semiconductor circuit device according to the present invention. The device comprises a substrate voltage detecting circuit 1 for detecting the substrate voltage $V_{SUB}$ and a substrate impedance adjusting circuit 2 for adjusting the substrate impedance according to the output of the detecting circuit 1.

The substrate voltage detecting circuit 1 is composed of a P-channel transistor TP1 having a source connected to a supply voltage $V_{CC}$, a gate connected to ground, and a drain connected to a node N1; a N-channel transistor TN1 having a drain connected to the node N1, a source connected to a node N2, and a gate connected to the supply voltage $V_{CC}$; a P-channel transistor TP2 having a source connected to the node N2, and gate and drain connected to the substrate voltage $V_{SUB}$ in common; an inverter INV1 having an input terminal connected to the node N1; and an inverter INV2 connected in series with the inverter INV1.

An output of the inverter INV2 is given to a node N4 of the substrate impedance adjusting circuit 2. To this node N4, an input terminal of an inverter INV3 is connected. An output terminal of the inverter INV3 is connected to a gate of a P-channel transistor TP4. Further, a gate of a P-channel transistor TP3 is connected to the node N4. Further, a drain of the P-channel transistor TP3 is connected to a drain of an N-channel transistor TN2, and a drain of a P-channel transistor TP4 is connected to a drain of an N-channel transistor TN3. The gates and drains of these two N-channel transistors TN2 and TN3 are connected to each other into a crossing state and the sources thereof are both connected to the substrate voltage ($V_{SUB}$) terminals. A gate Of an N-channel transistor TN4 is connected to a node N6 to which the drain of the N-channel transistor TN2 is connected. A drain of the N-channel transistor TN4 is connected to the ground ($V_{SS}$) terminal and a source thereof is connected to the substrate voltage ($V_{SUB}$) terminal.

Figure 2A:
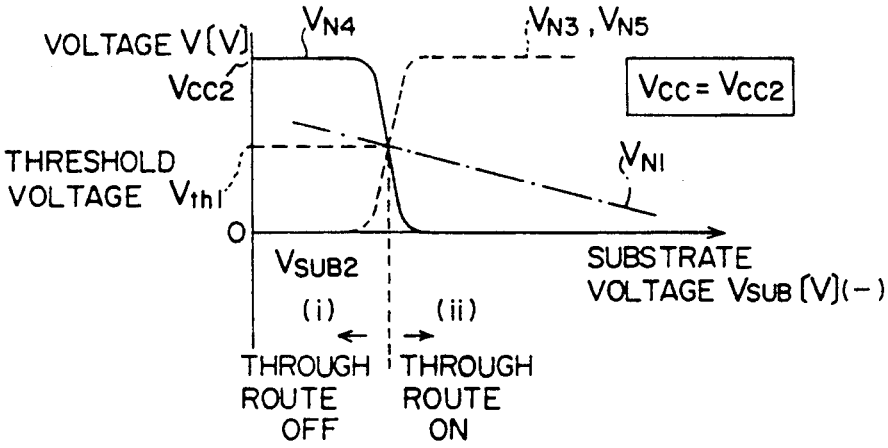
FIGS. 2A and 2B is a graphical representation for assistance in explaining the operation characteristics of the device shown in FIG. 1.
Figure 2B:
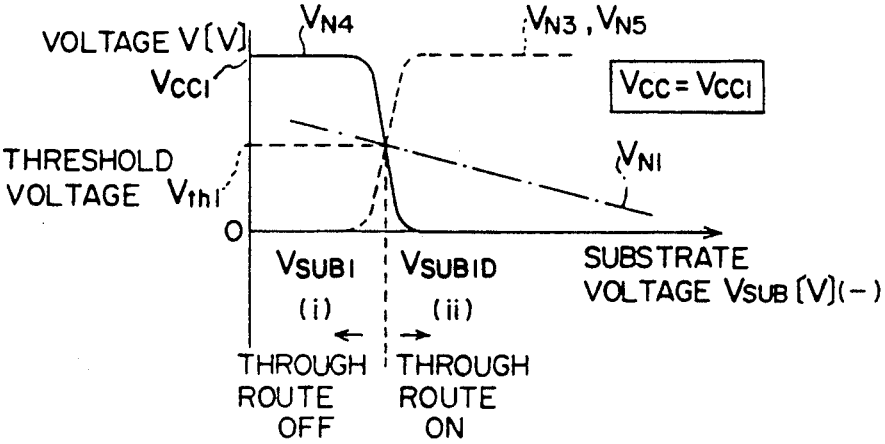

The operation of the semiconductor circuit device configured as described above will be explained with reference to voltage waveforms shown in FIGS. 2(*a*) and 2(*b*). The potential $V_{N1}$ at the node N1 of the substrate voltage detecting circuit 1 is determined by a potential division ratio of the resistance of the P-channel transistor TP1 to an addition of the resistances of the N-channel transistor TN1 and the P-channel transistor TP2. When the substrate voltage $V_{SUB}$ drops from $V_{SUB1}$ to $V_{SUB1D}$ due to supply voltage fluctuations, the potential $V_{N1}$ at the node N1 also decreases as shown in FIG. 2(*b*). When the substrate voltage $V_{SUB}$ drops markedly, since the potential $V_{N1}$ drops below a threshold voltage $V_{th1}$ of the inverter INV1 in the range (ii) as shown in FIG. 2, the potential $V_{N3}$ at the node N3 of the output terminal of the inverter INV1 becomes a high level. Therefore, the potential $V_{N4}$ at the node N4 of the output terminal of the substrate detecting circuit 1 outputs a low-level signal indicative of that the substrate voltage $V_{SUB}$ drops markedly.

In this embodiment, since a delay circuit is formed by the two inverters INV1 and INV2, a signal indicative of the detected substrate voltage is delayed before being outputted, thus preventing hunting generation.

When this low-level signal is inputted to the substrate impedance adjusting circuit 2, since the P-channel transistor TP3 is turned on, a high-level signal is inputted via the inverter INV3 to the gate (node N5) of the P-channel transistor TP4, so that the transistor TP4 is turned off. Therefore, the node N6 changes to a high level potential $V_{CC}$ and the node N7 changes to a low level potential $V_{SUB}$. As a result, since the N-channel transistor TN4 is turned on, a through route is formed between the substrate voltage ($V_{SUB}$) and the ground potential $V_{SS}$ (higher than $V_{SUB}$), so that the substrate impedance decreases. Therefore, the substrate voltage $V_{SUB}$ rises quickly up to the voltage $V_{SUB2}$ corresponding to the supply voltage $V_{CC2}$ which is stabilized after having once dropped.

As the substrate voltage increases, since the potential $V_{N1}$ at the node N1 of the substrate voltage detecting circuit 1 also increases, when the potential $V_{N1}$ exceeds the threshold voltage $V_{thl}$ of the inverter INV1 in the range (i) as shown in FIG. 2, the potential $V_{N3}$ at the node N3 changes to a low level, so that a high-level signal indicative of that the substrate voltage rises sufficiently high is outputted from the node N4 of the output terminal of the inverter INV2. In response to this high-level signal, the P-channel transistor TP3 of the substrate impedance adjusting circuit 2 is turned off, so that the potential at the node N6 changes to a low level $V_{SUB}$ and the potential at the node N7 changes to a high level $V_{CC}$ to turn off the N-channel transistor TN4. Accordingly, the through route formed between the substrate voltage ($V_{SUB}$) terminal and the ground potential ($V_{SS}$) terminal is cut off, so that the substrate impedance rises, thus preventing a wasteful power consumption.

As described above, where the substrate voltage drops markedly due to supply voltage fluctuations, since a through route can be formed between the substrate voltage and the ground voltage higher than the substrate voltage, it is possible to return the substrate voltage at high speed up to an appropriate level corresponding to the supply voltage in order to stabilize the operation of the circuits formed on the substrate. Further, after the supply voltage has returned to a predetermined level, the through route is cut off to reduce the power consumption rate.

Here, it should be noted that the timing at which the through route is turned on or off between the substrate voltage ($V_{SUB}$) terminal and the ground potential ($V_{SS}$) terminal can be easily controlled by adjusting a potential division ratio in resistance of the P-channel transistor TP1 to an addition of the N-channel transistor TN1 and the P-channel transistor TP2 or the threshold voltage of the inverter INV1.

Figure 3:
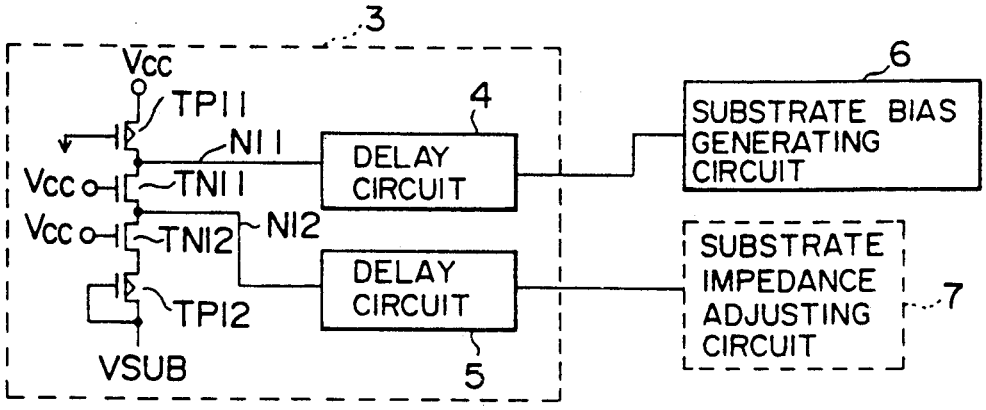
FIG. 3 is a circuit diagram showing another embodiment of the semiconductor circuit device according to the present invention.

FIG. 3 is a circuit diagram showing another embodiment of the present invention. In this embodiment, a substrate bias generating circuit 6 is additionally provided. Therefore, the feature of this embodiment is that this substrate bias generating circuit 6 allows the substrate voltage detecting means required to control the substrate bias to be provided in common in the substrate voltage detecting circuit 3. That is, the substrate voltage outputted by the substrate bias generating circuit 6 is detected by this substrate voltage detecting means. When the detected substrate voltage drops below a predetermined level, the substrate bias generating circuit 6 stops the operation of forming the substrate bias. Further, when the substrate voltage rises beyond a predetermined level, the circuit 6 operates again to generate the substrate bias.

In more detail, in the substrate voltage detecting circuit 3, a signal with a voltage level $V_{N11}$ is outputted from a node N11 according to a potential division ratio in resistance of an N-channel transistor TN11 to an addition of a P-channel transistor TP12 and an N-channel transistor TN12, to which a drain of a P-channel transistor TP11 having a gate connected to the ground and a source connected to a supply voltage $V_{CC}$ is connected. After having been delayed by a delay circuit 4 for hunting prevention, this signal is applied to the substrate bias voltage generating circuit 6 to control the substrate voltage. Further, another signal with a voltage level $V_{N12}$ is outputted from a node N12 according to a potential division ratio in resistance of an addition of a P-channel transistor TP11 and an N-channel transistor TN11 is an addition of an N-channel transistor TN12 and a P-channel transistor TP12. After having been delayed by a delay circuit 5, this signal is applied to the substrate impedance adjusting circuit 7. This substrate impedance adjusting circuit 7 is the same as that already explained with reference to FIG. 1. Therefore, in the same way as in the first embodiment, the through route formed between the substrate voltage ($V_{SUB}$) terminal and the ground potential ($V_{SS}$) terminal is controllably turned on or off.

In this embodiment, when the substrate voltage drops markedly, a through route is formed between the substrate voltage and the ground potential, so that it is possible to return the substrate voltage at high speed up to an appropriate level in order to stabilize the operation of the circuit formed on the substrate. After the supply voltage has returned, the through route is cut off to reduce the power consumption rate. Further, since means for detecting the substrate bias and outputting it to the substrate bias generating circuit is provided in common, it is possible to minimize the device size.

Figure 4A:
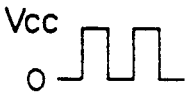
FIG. 4A is a waveform diagram of a pulse signal.
Figure 4B:
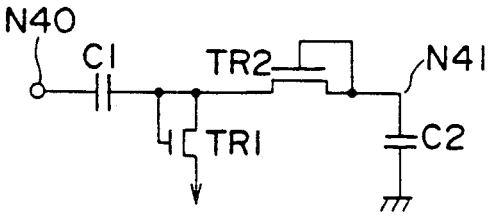
FIG. 4B is a circuit diagram showing a prior-art substrate bias generating circuit.
Figure 5:
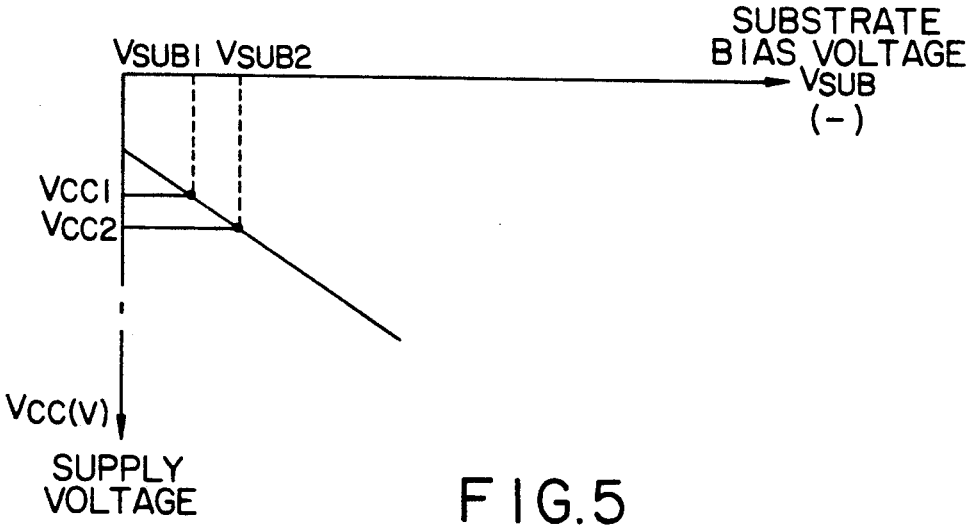
FIG. 5 is a graphical representation for assistance in explaining the operation characteristics of the prior-art circuit shown in FIG. 4B.
Figure 6:
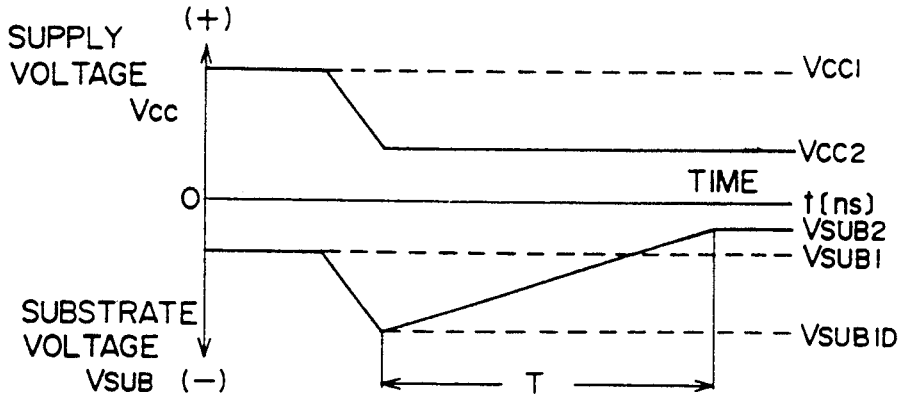
FIG. 6 is a graphical representation for assistance in explaining the change in substrate voltage $V_{SUB}$ with respect to the change in supply voltage $V_{CC}$.
Figure 7:
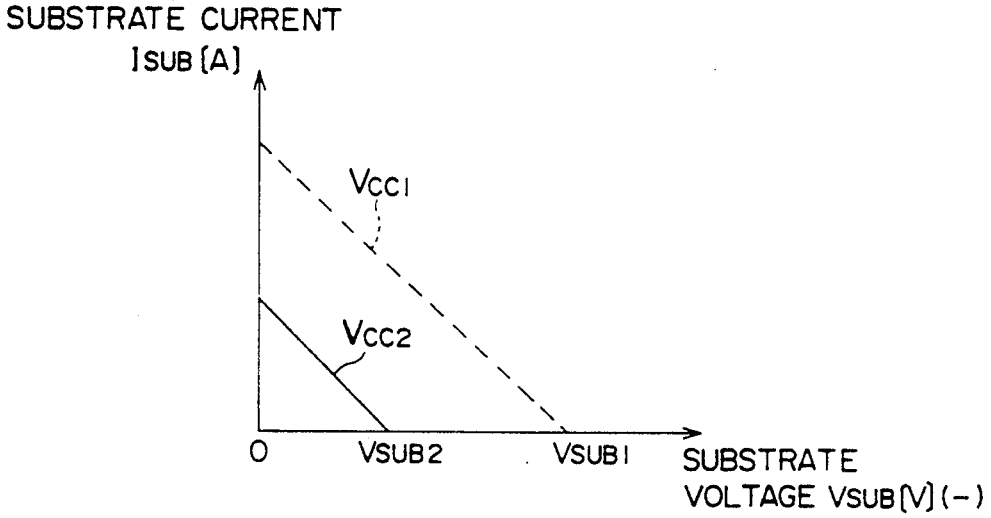
FIG. 7 is a graphical representation for assistance in explaining the load characteristics of the prior-art substrate bias generating circuit.

Here, the substrate bias generating circuit 6 always controls the generation of substrate bias voltage in such a way that the substrate voltage lies within a predetermined voltage range. The circuit configuration of this circuit 6 is substantially the same as that shown in FIG. 4. However, the control start voltage (at which the operation starts) of this substrate bias generating circuit 6 is different from that of the substrate impedance adjusting circuit 7 operated only when the substrate voltage drops markedly due to supply voltage fluctuations. The relationship between the two control start voltages should be $|V_B| < |V_Z|$, where $V_B$ denotes the control start voltage of the means for controlling the substrate bias generating circuit, and $V_Z$ denotes the control start voltage of the substrate impedance adjusting circuit.

The above-mentioned embodiments have been explained only by way of example. Without being limited thereto, various modifications can be considered. For instance, it is possible to configure the substrate voltage detecting circuit and the substrate impedance adjusting circuit in different way from those shown in FIG. 1. That is, any circuit is usable as long as a through route can be formed between the substrate voltage terminal and a voltage terminal higher than the substrate voltage only when the substrate voltage drops.

As described above, in the semiconductor circuit device according to the present invention, whenever the substrate voltage drops below a predetermined level due to supply voltage fluctuations, since a through route can be formed between the substrate voltage terminal and any given voltage terminal higher than the substrate voltage, the substrate voltage rises up to a predetermined level at high speed, thus allowing all the elements formed on the substrate and subjected to the influence of the substrate voltage to operate stably. Further, after the substrate voltage has reached the predetermined level, the formed through route is cut off to reduce power consumption.

What is claimed is:

1. An impedance control circuit for a semiconductor substrate, comprising:

a substrate bias generating circuit means for generating a substrate bias voltage to be applied to a substrate;

a substrate voltage detecting circuit means for detecting a substrate voltage provided by said substrate bias generating circuit means at a substrate voltage detection terminal;

a substrate impedance adjusting circuit means for adjusting impedance of the substrate by making a current through path between the substrate voltage detection terminal and a reference voltage terminal having a higher potential than that of the substrate voltage detection terminal to increase the substrate voltage when the detected substrate voltage detected by the substrate voltage detecting circuit means decreases below a predetermined level, and by cutting off the formed current through path when the substrate voltage has reached the predetermined level, said substrate impedance adjusting circuit comprising, a flip-slop circuit composed of a pair of N-channel transistors having a common substrate voltage terminal;

a pair of P-channel transistors for setting or resetting said flip-flop on the basis of a signal outputted by said substrate voltage detecting circuit; and a current through path forming transistor having a drain and a source connected between the substrate voltage detection terminal, respectively, and controlled in operation in response to output signals of the flip-flop circuit applied to a gate thereof.

2. An impedance control circuit for a semiconductor substrate as recited in claim 1, wherein said substrate voltage detecting circuit means comprises:

means for converting the detected substrate voltage into said signal provided to said impedance adjusting circuit, whose voltage level changes according to the detected substrate voltage; and means for delaying the converted signal.

3. An impedance control circuit for a semiconductor substrate of claim 1, wherein said substrate voltage detecting circuit means further comprises:

control signal outputting means for outputting a signal whose voltage level changes according to the substrate voltage to said substrate bias generating circuit means; and wherein said substrate impedance adjusting circuit means sets the substrate voltage required when the current through path is formed therein so that its absolute value is larger than an absolute value of a control start voltage required when the substrate bias generating circuit means starts control of the substrate bias voltage.

4. An impedance control circuit for a semiconductor substrate of claim 1, wherein said reference voltage terminal is ground level.

* * * * *

UNITED STATES PATENT AND TRADEMARK OFFICE

CERTIFICATE OF CORRECTION

PATENT NO. : 5,270,583

DATED : December 14, 1993

INVENTOR(S) : Naokazu MIYAWAKI et al.

It is certified that error appears in the above-indentified patent and that said Letters Patent is hereby corrected as shown below:

Column 1, line 24, "TP1" should read --TR1--.

Signed and Sealed this

Twenty-eighth Day of January, 1997

*Attest:*

Bruce Lehman

BRUCE LEHMAN

*Attesting Officer*

*Commissioner of Patents and Trademarks*